United States Patent [19]

Evans et al.

[11] 4,015,162

[45] Mar. 29, 1977

[54] FLUORESCENT LAMP HAVING IMPLANTED AMALGAMATIVE METAL FOR MERCURY VAPOR REGULATION

[75] Inventors: George S. Evans, Caldwell; Henry Skwirut, Verona, both of N.J.

[73] Assignee: Westinghouse Electric Corporation, Pittsburgh, Pa.

[22] Filed: July 7, 1975

[21] Appl. No.: 593,814

[52] U.S. Cl. ..... 313/490; 313/174

[51] Int. Cl.[2] ..... H01J 61/24

[58] Field of Search ..... 313/490, 485, 178, 174

[56] References Cited

UNITED STATES PATENTS

| | | | |
|---|---|---|---|
| 3,629,641 | 12/1971 | Hofmann et al. | 313/490 |
| 3,683,227 | 8/1972 | Shindelman et al. | 313/490 |
| 3,858,075 | 12/1974 | Herrmann et al. | 313/178 |
| 3,859,555 | 1/1975 | Latassa et al. | 313/490 |
| 3,906,285 | 9/1975 | Frank et al. | 313/490 |

*Primary Examiner*—R. V. Rolinec
*Assistant Examiner*—Vincent J. Sunderdick
*Attorney, Agent, or Firm*—D. S. Buleza

[57] ABSTRACT

The mercury-vapor pressure within an operating fluorescent lamp is regulated by several discrete bodies or bits of a suitable amalgamative metal (such as an indium-tin alloy in the form of pellets) that are anchored at fixed sites within the lamp during the manufacture thereof. Emplacement of the metal pellets is achieved by dropping them into the open upper end of the envelope while the circumferential seal of fused glass which joins the stem to the opposite end of the envelope is still hot and "tacky" as a result of the sealing-in operation. The metal pellets automatically fall toward and contact the newly-formed circumferential seal and remain fused and bonded to its surface after the glass cools and rigidifies. The introduction of a controlled amount of an amalgamative metal into the lamp and its emplacement in a strategic but inconspicuous location at one or both ends of the sealed envelope are thus achieved in a very simple and economical manner during the normal sequence of operations required to manufacture the lamp.

14 Claims, 7 Drawing Figures

FIG. 1
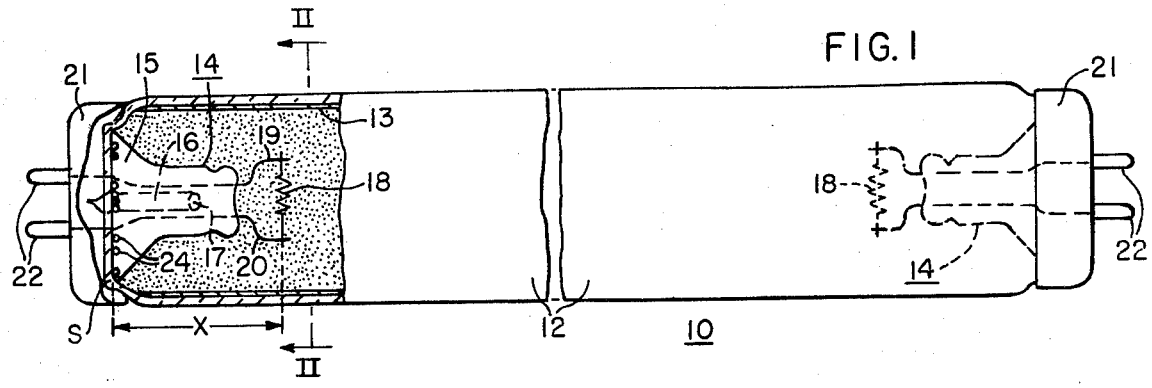
FIG. 2
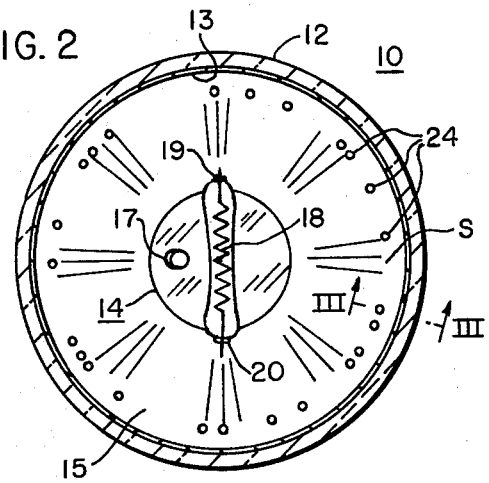
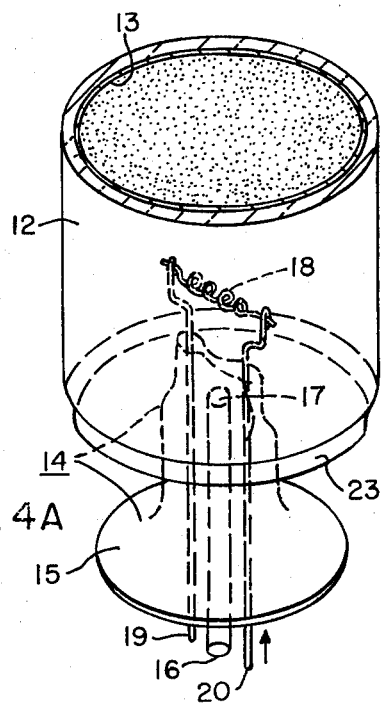
FIG. 4A
FIG. 5
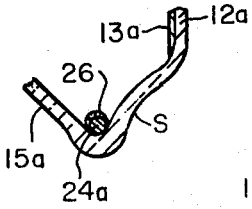
FIG. 4C
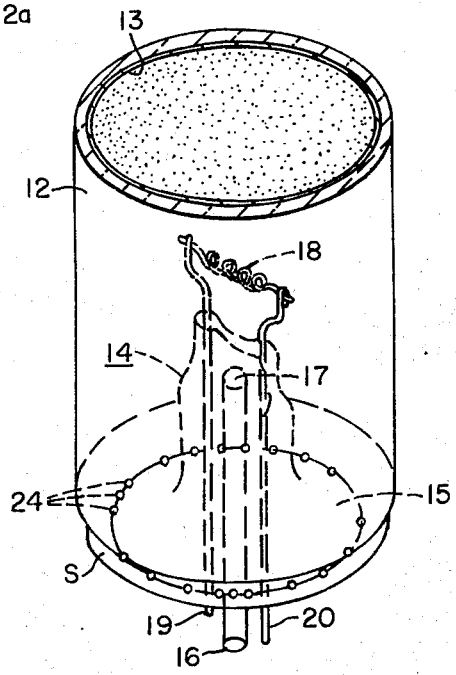
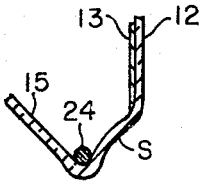
FIG. 3
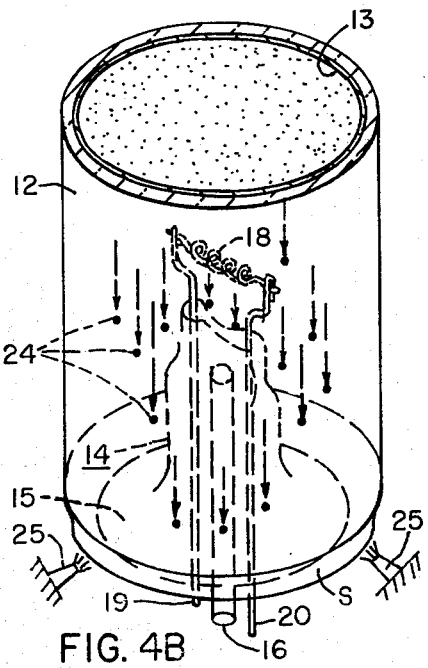
FIG. 4B

FLUORESCENT LAMP HAVING IMPLANTED AMALGAMATIVE METAL FOR MERCURY VAPOR REGULATION

CROSS-REFERENCE TO RELATED APPLICATIONS

The subject matter of this application is related to and constitutes an improvement over that disclosed and claimed in pending applications Ser. Nos. 293,239 and 473,959 now U.S. Pat. No. 3,898,720 of Chalmers Morehead filed Sept. 28, 1972 and May 28, 1974, respectively, and assigned to the assignee of the present invention.

BACKGROUND OF THE INVENTION

1. Field of the Invention

This invention relates to the electric lamp art and has particular reference to an improved amalgam-containing low-pressure discharge lamp, such as a fluorescent lamp.

2. Description of the Prior Art

Fluorescent lamps that contain a suitable metal, such as indium or the like, which combines with the mercury dosed into the lamp to form an amalgam that controls the pressure of the mercury vapor during lamp operation are well known in the art. Fluorescent lamps having a disc-shaped body of amalgamative metal which is attached to the inner surface of the bulb between the electrodes are disclosed in U.S. Pat. Nos. 3,152,278 and 3,351,797. Another fluorescent lamp design that is provided with a circumferential band of indium-mercury amalgam which is disposed on the inner surface of the bulb midway between the electrodes is disclosed in U.S. Pat. No. 3,392,298. According to another concept indium, in the form of a powder, is admixed with the phosphor particles that are coated onto the inner surface of a fluorescent lamp envelope (U.S. Pat. No. 3,339,100).

A more recent trend in the evolution of amalgam-type fluorescent lamps is to place tha amalgamative metal on the glass stems that are sealed into the ends of the bulb. A fluorescent lamp having a stem component that is provided with a thin layer of amalgam-forming metal which is sprayed onto the flared skirt portion of the glass stem is disclosed in U.S. Pat. No. 3,548,241. A fluorescent lamp having a thin sleeve of amalgamative metal that is held in encircling relationship with the tubular part of the stem by a wire-mesh collar assembly is described in U.S. Pat. No. 3,619,697 issued to G. S. Evans, one of the joint authors of the present invention. In other recently developed and known amalgam-fluorescent lamps the amalgamative metal is deposited on an anode or a shield structure that is associated with the cathode, or it is placed within the tipped-off exhaust tubulation of one of the stems.

In the improved amalgam-type fluorescent lamps disclosed and claimed in the aforementioned pending applications Ser. Nos. 293,239 and 473,959 of Chalmers Morehead, the amalgamative metal is divided into a plurality of discrete bodies or bits that are attached directly to the vitreous stem before the latter is sealed to the rim of the envelope. Such attachment is achieved by heating the stem and pressing the metal bits against the hot surface of the stem to fuse the bits to the glass, or the metal bits are disposed in recesses that are molded into the stem surface. When metal bits of large size and mass are employed, a layer of inert material that is porous to mercury vapor is applied over the bits and attached to the surrounding portions of the stem to prevent the heat-softened or melted bits from falling off the stem during the sealing-in operation. A porous matrix of fused admixed material can also be used as an auxiliary retaining means.

SUMMARY OF THE INVENTION

While the prior art amalgam-type fluorescent lamps and amalgam-bearing components were generally satisfactory from a functional standpoint, they required specially made parts or a separate manufacturing operation (or series of such operations) which complicated the fabrication of the lamps on a mass production basis and increased their unit cost. These problems and disadvantages are avoided in accordance with the present invention by introducing the amalgamative metal into the lamp and securely anchoring it at a fixed strategic location or site within the envelope during the normal sequence of operations required to manufacture the lamp.

Briefly, this is accomplished by dropping one or more pieces of amalgamative metal (preferably in spherical pellet form) into the open end of the envelope immediately after the opposite end has been heat-sealed to the glass stem while the envelope is held in a vertical position on the sealing machine. The metal pellets fall into the channel-like circumferential glass seal formed by the joined flared skirt of the stem and the rim of the envelope while the glass is still hot and tacky — and the pellets are thus fused to the inner surface of the hot seal and remain bonded to it after the glass has cooled and regidified. The required quantity of amalgamative metal is accordingly introduced into the lamp and automatically anchored at a fixed unobtrusive site (or sites) within the envelope during the sealing-in operation without the aid of any additional components and without interrupting the normal sequence of operations required to manufacture the lamps on an efficient mass production basis with the high-speed lamp-making machines now in use.

In an alternative embodiment the pellets or bodies of amalgamative metal are coated with a porous layer of a suitable inert material before they are dropped into the lamp envelope so that the portions of the anchored pellets which are exposed to the lamp interior are covered by the coating. This prevents the liquid mercury, which is dosed into the lamp during a subsequent operation, from striking and being absorbed by the implanted bodies of amalgamative metal and softening them to a degree that they become detached from the glass seal and are free to move about in the finished lamp. This would be undesirable since one or more of the metal bodies may become attached to one of the electrodes and be vaporized and thereby impair the quality of the lamp.

BRIEF DESCRIPTION OF THE DRAWINGS

A better understanding of the invention will be obtained from the exemplary embodiments shown in the drawing, wherein:

FIG. 1 is a side elevational view of a fluorescent lamp embodying the invention, a portion of the envelope being removed to show the structure of one of the lamp stems and the implanted amalgamative-metal pellets on the glass seal;

FIG. 2 is an enlarged cross-sectional view of the lamp, along line II—II of FIG. 1, showing the manner in which the anchored pellets of amalgamative metal are randomly distributed along the circumferential seal of fused glass which joins the stem flare to the envelope;

FIG. 3 is a fragmentary cross-sectional view through the glass seal, along line III—III of FIG. 2, illustrating the manner in which the metal pellets are bonded to the bottom portion of the channel-shaped seal;

FIGS. 4A through 4C are perspective views of one end of the lamp envelope and its associated stem assembly illustrating various steps in the sealing-in and pellet-implanting operations; and FIG. 5 is an enlarged cross-sectional fragmentary view of an alternative amalgam-seal structure wherein the exposed portions of each of the implanted amalgamative-metal pellets are provided with a protective porous coating of inert material.

DESCRIPTION OF THE PREFERRED EMBODIMENTS

While the invention can be advantageously employed in the manufacture of various kinds of electric discharge devices that contain a vaporizable metal (such as mercury) and require some means for regulating the metal-vapor pressure within the device when the latter is energized and operated, it is particularly adapted for use in conjunction with low-pressure type electric discharge lamps such as fluorescent lamps and has accordingly been so illustrated and will be so described.

Such a lamp 10 is shown in FIG. 1 and comprises the usual tubular envelope 12 of vitreous material that is provided with an inner coating 13 of suitable ultraviolet-responsive phosphor and contains a suitable ionizable medium. The envelope 12 is closed at each end by a vitreous stem 14 which has a flared skirt portion 15 that is fused to the rim of the envelope in the customary manner and provides a circumferential hermetic seal S. One of the stems 14, as shown, is provided with an axially-disposed exhaust tubulation 16 that communicates with an opening 17 in the stem wall and has its outer end hermetically tipped-off after the envelope 12 has been evacuated, charged with a suitable fill gas (such as argon or a mixture of neon and argon to a suitable pressure below 10 Torr), and dosed with a measured amount of mercury in accordance with standard lamp-making practice.

For the reasons hereinafter stated, the amount of mercury dosed into the lamp 10 is very carefully controlled and monitored.

Each stem 14 supports a suitable electrode 18 such as a tungsten coil that is coated with well-known electron-emissive material. The electrodes 18 are fastened to an associated pair of lead wires 19, 20 which are sealed through the press of stem 14 and extend into a base 21 that is cemented to and encloses the respective sealed-ends of the envelope 12. The bases 21 are provided with a pair of suitable terminals, such as metal pins 22, that are electrically connected to the lead wires 19, 20 by soldering or welding.

In accordance with the present invention, the pressure of the mercury vapor within the fluorescent lamp 10 during operation is controlled by a predetermined and measured quantity of a suitable amalgamative metal which is divided into a number of small bodies or bits, preferably pellets 24 of generally spherical configuration as shown, that are attached directly to the vitreous juncture or seal S which joins the stem flare 15 to the rim of the envelope 12 and extends around the envelope circumference. The metal pellets 24 are fused or heat-bonded directly to the inner surface of the seal S in the manner hereinafter described and thus require no other means or auxiliary parts for retaining them in place within the finished lamp 10.

As shown more particularly in FIGS. 2 and 3, the implanted pellets 24 of amalgamative metal are randomly distributed along the circumferential fused-glass seal S and are attached to the curved inner surface of the seal that constitutes the bottom or "valley" portion of the channel-shaped seal structure. The attached pellets 24 thus protrude from the seal S and have a large part of their surface exposed to the interior of the envelope 12 and the lamp atmosphere. The implanted pellets 24 are, accordingly, able to combine with the liquid mercury that is dosed into the envelope 12 and thus form a series of amalgam bodies in the completed lamp 10. When thus amalgamated with the dosed mercury, the pellets 24 collectively function as the main source of amalgam which controls the mercury vapor pressure within the finished fluorescent lamp 10 when it is energized and operated.

Since the circumferential seal S and implanted metal pellets 24 are hidden from view by the enclosing portion of the attached base member 21, the fluorescent lamp 10 is provided with an integral vapor-pressure regulating means that is invisible but reliable.

Proper regulation of the mercury-vapor pressure requires that the amalgam be heated to and maintained at the proper temperature when the lamp 10 is energized and is operating in a stabilized manner. This requirement is met by the invention since each of the pellets 24 are spaced a fixed predetermined axial distance (dimension $x$ in FIG. 1) from the associated electrode 18 which constitutes the hottest component within the energized lamp. Such equal spacing is an inherent feature of the finished lamp 10 since the bottom portion of the circumferential seal S and pellets 24 implanted thereat lie in a common plane that is normal to the longitudinal axis of the lamp 10 and is located a given distance $x$ from the nearest electrode 18.

Of course, the operating temperature of the amalgam (and the resultant mercury-vapor pressure which it provides) can readily be changed by simply increasing or decreasing the length of the stem 14 and thus altering the axial spacing between the pellets 24 and the associated electrode 18.

The operating mercury-vapor pressure within the fluorescent lamp 10 also depends upon the composition of the amalgam. This, of course, requires that the quantity of mercury dosed into the lamp be properly and very carefully correlated with the total amount of amalgamative metal introduced in pellet form. Satisfactory control of the mercury-vapor pressure has been obtained in the case of a 40 watt fluorescent lamp approximately 122 centimeters long having an envelope 38 mm. in diameter and stems which provided an amalgam-electrode spacing of approximately 32 mm. by utilizing 50.5 milligrams amalgamative metal of an alloy containing 50 percent by weight indium and 50 percent by weight tin. The lamp contained argon at a fill pressure of 2.2 torr and was dosed with 32 milligrams of mercury. The In-Sn alloy was divided into 5 spherical pellets, each approximately 1.4 millimeters in diameter and 10.1 milligram in weight.

While indium, either in pure form or alloyed with tin, is preferred because it offers advantages in both lamp fabrication and performance, the amalgamative metal can comprise any metal which will combine with mercury to form a suitable amalgam within the finished lamp 10. Cadmium, gallium, gold, lead, tin, zinc and alloys thereof can thus also be employed as the amalgamative metal. Indium-tin alloys of various other compositions can also be used pursuant to the teachings of U.S. Pat. No. 3,526,804 (G. S. Evans et al.), which teachings are incorporated herein by reference.

It will also be understood to those skilled in the art that while the amalgamative-metal pellets 24 implanted in the fused glass seal S of the fluorescent lamp 10 pursuant to the specific embodiment shown in FIGS. 1–3 collectively constitute the main or "control" source of amalgam and not an "auxiliary" source of amalgam that is used for quickly releasing mercury vapor and accelerating the rise in light output after the lamp is first turned on, it is within the scope of the present invention to utilize such seal-implanted bodies of amalgamative metal as one source of mercury vapor within the finished lamp in combination with one or more additional sources of mercury vapor at other locations within the lamp to effect a more rapid stabilization of the energized lamp — or to provide other advantages. Pellets or other metal bodies can also be implanted in the circumferential seals at both ends of the lamp instead of just one of them, as in the illustrated embodiment.

METHOD OF MANUFACTURE (FIGS. 4A–4C

The various operations involved in sealing the glass stem 14 to the envelope 12 and concurrently implanting the amalgamative-metal pellets 24 in the newly-formed glass seal S in accordance with the invention are shown in FIGS. 4A through 4C and will now be described.

As illustrated in FIG. 4A, the phosphor-coated glass envelope 12 is held in upstanding and preferably vertical position while the glass stem 14 with its mounted electrode 18 is inserted into the bottom of the envelope until the rim of the flare 15 is approximately aligned with the shouldered rim 23 of the envelope. The upper end of the envelope 12 (not shown) is not sealed to the other stem assembly and thus remains open at this stage of lamp fabrication.

As shown in FIG. 4B, the adjacent peripheral rims or edges of the envelope 12 and stem flare 15 are then subjected to a plurality of sealing fires from a series of spaced gas burners 25 that uniformly heat the glass until it is plastic, at which time a suitable retractable mold (not shown) is applied to the molten glass to join the rims and form a circumferential seal of fused glass in the usual manner. This heating-molding cycle is repeated several times until a strong hermetic seal S is formed. The heat intensity is then progressively reduced to permit the fused glass to become rigid, annealed, and then finally cool enough to permit the partly-fabricated lamp to be handled. The foregoing operations are all automatically performed by standard well-known lamp-making machines presently being used in the industry.

During the second or one of the later seal-molding operations, the pellets 24 of amalgamative metal are simply dropped into the open upper end of the envelope 12 so that they fall (as indicated by the arrows in FIG. 4B) toward the stem 14 and the newly-formed circumferential seal S which is still hot and thus has a plastic and adhesive or tacky surface. Since the seal S inherently has sloping side walls and is of channel-like configuration and the stem flare 15 is also tapered, the metal pellets 24 gravitate to the curved bottom portion of the seal and stick to its hot surface. The pellets 24 melt and "wet" the hot glass and are thus automatically fused to the surface of the seal S at randomly-spaced locations around the seal but in substantially the same transverse plane, as shown in FIGS. 1–3 and 4C.

It has been found that if the glass seal S is hot and plastic enough, the dropped metal pellets 24 will actually become partly embedded in the glass surface and that the latter, at the points of contact with the metal pellets, will be indented and form craters or pockets which nestingly accommodate the pellets. The pellets 24 are thus securely anchored in the seal S.

However, it has also be found that good adherence and satisfactory attachment of the metal pellets 24 are also obtained when they are introduced into the envelope 12 during later phases of the seal-molding operation when the glass seal S is hot but not plastic and the aforementioned local deformation or "cratering" of the seal surface does not occur. The pellet-implantation process is thus not critical in this respect.

Upon completion of the stem "sealing-in" operation and emplacement of the metal pellets 24 in the surface of the seal S, the opposite end of the envelope 12 is sealed to the other stem assembly and the tubulation 16 is connected to a suitable vacuum system. The envelope 12 is then evacuated while being subjected to a baking operation, dosed with liquid mercury and filled with a suitable starting gas, and finally tipped-off and based in accordance with standard lamp-making techniques. Factory test runs with indium-tin alloys have revealed that all of the implanted metal pellets 24 remain firmly fixed in place on the glass seal S at their original sites during these subsequent operations with the fused amalgamative metal wetted and heat-bonded to the glass. Polariscope examination of the seals S has shown that there are no strain patterns in the glass associated with the implanted metal pellets 24 and thermal-cycling tests of the finished lamps have demonstrated that the anchored pellets do not weaken the seal structure or constitute sites of subsequent seal cracks which would, of course, ruin the finished lamp.

As illustrated in the drawing, the metal pellets 24 are preferably implanted in the seal S which is located at the tubulated end of the envelope 12 so that the liquid mercury, which is subsequently dispensed into the envelope through the stem tubulation 16, will drop into the opposite end of the envelope. This prevents the dosed mercury from hitting the implanted pellets 24 and avoids the potential danger that one or more of the pellets will absorb a sufficient amount of liquid mercury to become fluid and detached from the seal S. However, if it is desirable to control the mercury vapor pressure from both ends of the finished lamp 10, then pellets of amalgamative metal can be implanted in both of the stem-envelope seals S. Of course, in this case the metal pellets will first be implanted in the glass seal which joins the tubulated stem to the envelope — thereby permitting pellets to be implanted in the other seal by dropping them into the exhaust tubulation before it is tipped off.

ALTERNATIVE EMBODIMENT (FIG. 5)

It has been discovered that detachment of the implanted amalgamative-metal pellets 24 by the aforementioned mercury-absorption mechanism during lamp fabrication can be avoided by coating each of the pellets with a thin layer of suitable inert material before they are dropped into the envelope. The coating must be porous to mercury vapor and prevent the impinging liquid mercury from coming in contact with the pellets. Obviously, the coating must not interfere with the proper adherence and attachment of the metal pellets 24 to the glass seal S and it must not be a source of contamination. It should thus be inert with respect to the ionizable medium (fill gas and mercury) and all of the other interior components of the lamp so as not to chemically react with them or release vaporous impurities. Suitable coating materials are powders formed from stable metal oxides (such as titania, zirconia, etc.), carbon, glass dust, phosphors, or metal powders (aluminum or other non-amalgamating type metals). Other coating materials which can be used are borax, antimony oxide and even such plastics as teflon which are stable at high temperature.

The amalgamative-metal bodies or pellets can be coated en masse by shaking them vigorously in the powder. Since metals such as indium or indium-rich alloys are soft, the powder will abraid and inherently stick to the surface of such pellets during this operation. The coating operation will be facilitated if the pellets are warmed. Alternatively, the pellets can be wetted with a liquid suspension of the powder and then dried. The coating is very thin and a coating thickness of approximately 5 microns is satisfactory.

In the embodiment shown in FIG. 5 the implanted pellets **24*a* have been provided with such a protective porous coating 26 of inert material. As will be noted, while the coating 26 has been removed from the portion of the pellet 24*a* that is attached to the glass seal S (either by the intense heat to which it is subjected during the implantation process or by being assimilated by the hot glass), it remains on the protruding portion of the pellet 24*a*** that is exposed to the interior of the finished lamp.

While the present invention can be employed in various types and sizes of low-pressure discharge lamps and fluorescent lamps, it is especially suited for use in 40 watt fluorescent lamps that are employed in enclosed luminaires (such as multi-lamp troffer and "wrap-around" types of fixtures) since the efficiency and light output of such lamps are drastically impaired by the high temperature conditions which prevail in such fixtures. The output of a standard (non-amalgam) 40 watt fluorescent lamp operated in the open air peaks at an ambient air temperature around 21° to 24° C. However, the temperature of the air in a recessed four-lamp troffer fixture reaches 43° C and higher, at which temperature the aforesaid standard 40 watt fluorescent lamp experiences a light loss of about 17 percent of its peak output. The present invention makes it economically feasible to incorporate a suitable amalgam as an integral component in standard type 40 watt fluorescent lamps which will minimize the drop in light output and efficiency of the lamps under such adverse operating conditions.

We claim as our invention:

1. In combination with an electric discharge lamp having an envelope that contains spaced electrodes and an ionizable medium which includes mercury, integral means for regulting the mercury vapor pressure within the envelope during the operation of said lamp comprising;

a member that is secured to a portion of said envelope by a juncture which comprises a part of the interior structure of the lamp, and a body of amalgamative metal that is bonded to and protrudes from the surface of said juncture and is thus anchored at a fixed location within the envelope and exposed to the lamp atmosphere, said body of amalgamative metal being of such size that it extends over only a small segment of the juncture and is held in place on the juncture solely by the bond between the metal and said juncture, and said amalgamative metal being of a type that combines with mercury to form an amalgam and is thus adapted to serve as a source of mercury vapor when the lamp is energized and effects concomitant heating of the body of amalgamative metal.

2. The electric discharge lamp of claim 1 wherein;

said envelope is composed of vitreous material, said member comprises a vitreous component that is fused to said envelope and forms a vitreous seal therewith which constitutes said juncture, and said body of amalgamative metal is bonded to said vitreous seal.

3. The electric discharge lamp of claim 2 wherein said body of amalgamative metal is partly embedded in said vitreous seal.

4. The electric discharge lamp of claim 1 wherein the portion of said body of amalgamative metal that is exposed to the lamp atmosphere is covered with a layer of material that is porous to mercury vapor and chemically inert with respect to the ionizable medium and other internal components of the lamp.

5. The electric discharge lamp of claim 1 wherein a plurality of discrete bodies of amalgamative metal are bonded and anchored to said juncture at spaced sites, and said bodies of amalgamative metal are so disposed that they collectively control the mercury-vapor pressure within the lamp during the operation thereof.

6. The electric discharge lamp of claim 1 wherein:

said envelope is composed of vitreous material, said member comprises a component of the lamp that is secured to and hermetically closes one end of said envelope, said juncture comprises a seal that is formed by the parts of said envelope and component which are secured to one another and said seal extends around at least part of the periphery of the associated end of the envelope, and a plurality of discrete bodies of amalgamative metal are anchored to said seal at randomly-spaced locations therealong, said bodies of amalgamative metal being of such size that they collectively provide a predetermined amount of amalgamative metal within the lamp which is sufficient to control the mercury-vapor pressure within the lamp during the operation thereof.

7. The electric discharge lamp of claim 6 wherein said ionizable medium comprises a fill gas at a pressure below about 10 Torr and said lamp thus comprises a low-pressure discharge lamp.

8. The electric discharge lamp of claim 7 wherein;

said envelope is of elongated tubular configuration, contains a pair of spaced electrodes, and has a phosphor coating on its inner surface and said electric discharge lamp thus comprises a fluorescent lamp, said component comprises an electrode-supporting vitreous stem that is fused to the rim of the envelope and forms therewith a vitreous seal that extends around the envelope circumference, and said discrete bodies of amalgamative metal are anchored to said circumferential vitreous seal at randomly spaced locations.

9. The fluorescent lamp of claim 8 wherein;

said discrete bodies of amalgamative metal are of pellet-like configuration and substantially uniform dimensions, and the opposite end of said envelope is closed by a second electrode-supporting vitreous stem that is fused to the envelope rim thereat and forms a second circumferential vitreous seal.

10. The fluorescent lamp of claim 8 wherein the stem associated with said discrete bodies of amalgamative metal includes a closed remnant of an exhaust tubulation.

11. The fluorescent lamp of claim 8 wherein the exposed portions of each of said amalgamative metal bodies are covered by a layer of a material that is porous to mercury vapor and chemically inert with respect to the contained atmosphere and other internal components of the lamp.

12. The fluorescent lamp of claim 8 wherein;

the portion of said vitreous stem that is fused to the envelope rim comprises a flared skirt which, together with said envelope rim, defines a circumferential vitreous seal of channel-like configuration, and said anchored bodies of amalgamative metal are located at the bottom portion of said channel-like circumferential vitreous seal.

13. The fluorescent lamp of claim 8 wherein the circumferential vitreous seals at both ends of the envelope have a plurality of amalgamative metal bodies anchored thereto at randomly-spaced locations.

14. The fluorescent lamp of claim 8 wherein said envelope has an attached base member with a portion that encloses the circumferential vitreous seal and renders the anchored bodies of amalgamative metal invisible from outside the lamp.

* * * * *